United States Patent [19]

Loveless et al.

[11] 4,110,493

[45] Aug. 29, 1978

[54] SYSTEM AND METHOD FOR COATING CONTAINER SEAMS

[75] Inventors: John H. Loveless; Claude T. Phillips, both of Arden, N.C.

[73] Assignee: Gerber Products Company, Fremont, Mich.

[21] Appl. No.: 619,875

[22] Filed: Oct. 6, 1975

[51] Int. Cl.[2] ..... B21D 51/00; B05D 7/22

[52] U.S. Cl. ..... 427/233; 113/120 A; 198/394; 427/234

[58] Field of Search ..... 427/234, 233, 236; 220/64; 118/317, 318; 198/394; 113/120 A

[56] References Cited

U.S. PATENT DOCUMENTS

| | | | |
|---|---|---|---|
| 2,069,872 | 2/1937 | Burns | 198/394 |
| 2,178,618 | 11/1939 | Taylor | 220/64 |
| 2,181,319 | 11/1939 | Flugge | 220/64 |
| 2,797,023 | 6/1967 | Kaercher | 220/64 |
| 2,798,456 | 7/1957 | Pearson | 427/236 |
| 2,843,253 | 7/1958 | Peterson et al. | 198/394 |
| 2,919,788 | 1/1960 | Geertsen | 198/394 |
| 2,927,044 | 3/1960 | Gough | 427/234 |
| 2,966,874 | 1/1961 | Barr | 220/64 |
| 3,726,711 | 9/1970 | Hogstrom | 427/234 |
| 3,977,358 | 8/1976 | Stroobants | 198/379 |

*Primary Examiner*—Ronald H. Smith
*Assistant Examiner*—Silverberg S.
*Attorney, Agent, or Firm*—Townsend and Townsend

[57] ABSTRACT

A system and method of coating the same on the inside surface of a container is disclosed. The container is initially spun about an axis generally parallel to the seam. The seam of the container is engaged while the container is rotating to stop the container with the engaging means in registry with the seam. The interior of the container is coated along the seam while the container is stopped to provide a protective coating overlying the seam. If desired, a subsequent protective coating can be applied on the entire inside surface of the container.

4 Claims, 5 Drawing Figures

FIG _ 2
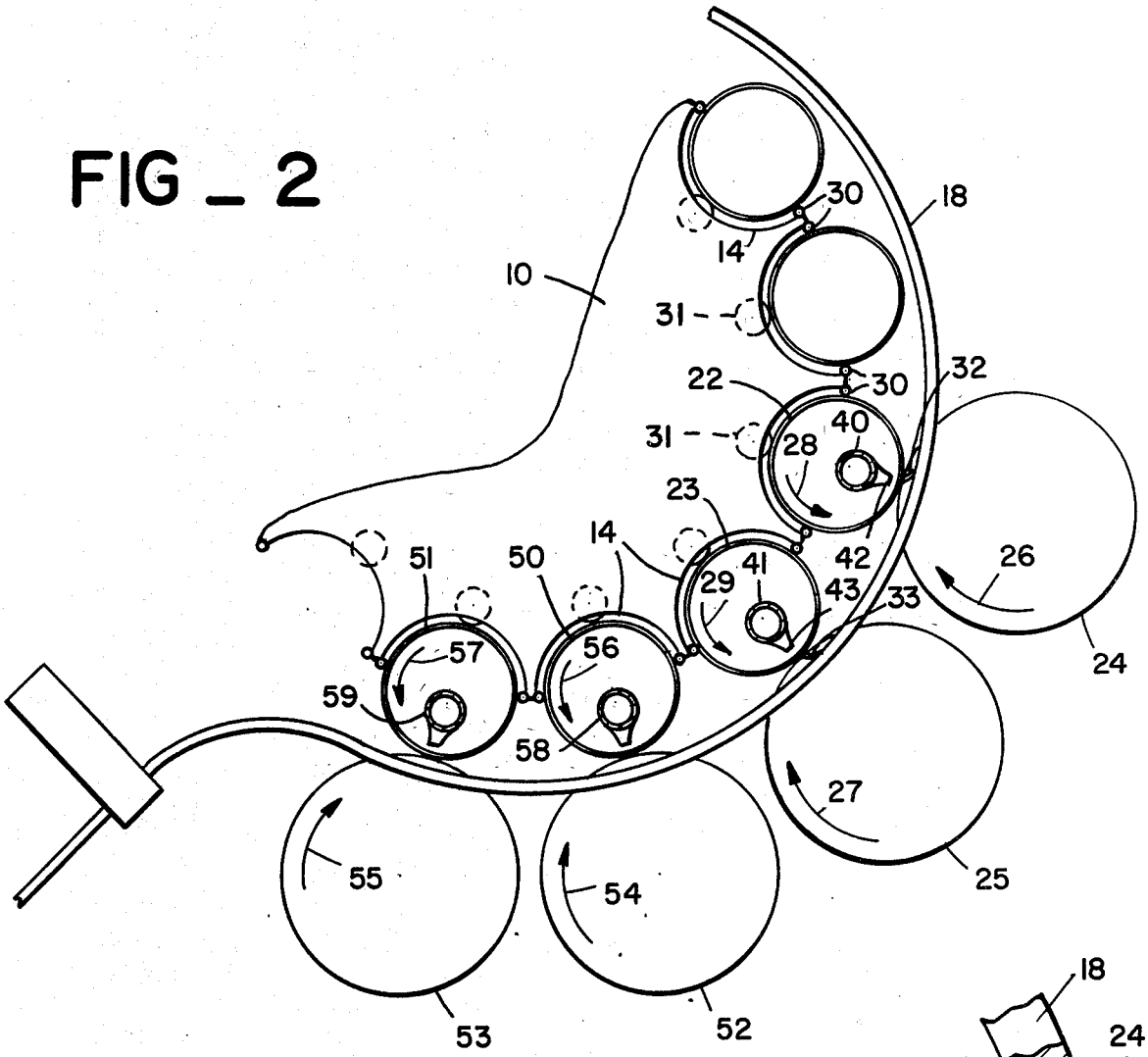
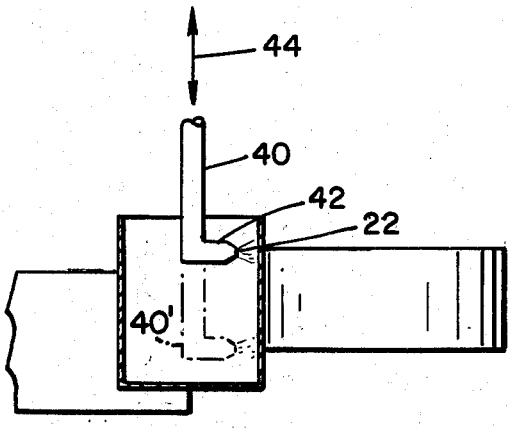
FIG _ 3
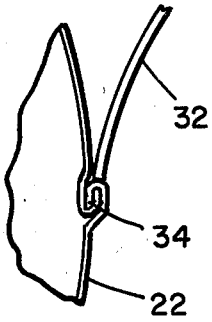
FIG _ 5
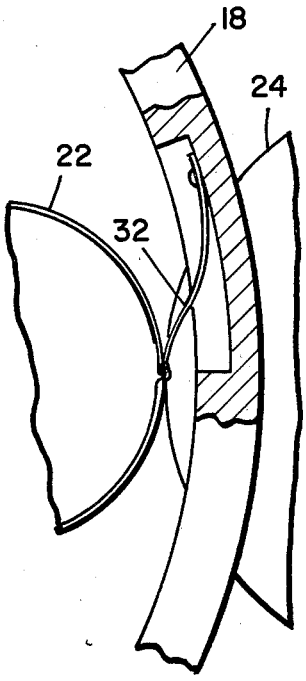
FIG _ 4

SYSTEM AND METHOD FOR COATING CONTAINER SEAMS

BACKGROUND OF THE INVENTION

Metal containers, usually called "tin cans", are often used in the food packaging industry. Such containers have a generally cylindrical configuration. The cylindrical portion of the container is constructed from sheet steel, which may or may not be coated with tin. The sheet steel is formed into a cylindrical configuration and the ends of the sheet are joined along a seam. This seam is usually soldered to provide the container with an airtight seal.

The metal used to construct such containers is ordinarily provided with a protective coating before the metal is used to form the container so that the metal itself will not react with the contents of the container. However, the solder used at the seam is exposed after the container has been constructed. Solder includes a major proportion of lead, and chemical or corrosive attack by the contents of the container can result in a substantial introduction of lead into the contents. Where food is involved or other liquid which is sensitive or its subsequent use is sensitive to lead, it is necessary that the solder be completely coated with a coating which is impermeable to the can contents. In addition, as the can is being constructed, the protective coating applied to the original metal may become scratched or otherwise damaged, particularly at the seam, and it may be necessary to recoat the remainder of the container.

To protect the contents of the container from the solder at the seam and other metal exposed as the container is constructed, the usual procedure in the construction of such containers is to apply two full 360° protective coatings to the interior of the container. The containers are spun about their central axes, and a nozzle is introduced along the axis of the container as it is spinning to fully coat the interior of the container.

Two coatings are used in the prior art to insure that the seam of the container, and particularly the solder used at this seam, are fully and completely coated. Relatively heavy coats are applied each time to further insure that the solder is fully coated and no portions of the seam are exposed. However, by using two such heavy coats throughout the entire interior of the can, a substantial amount of such coating material is applied to the interior of the container other than at the seam. These two heavy coatings are unnecessary other than at the seam because only minor scratches in the protective coating already on the metal exist on the interior of the container other than at the seam. As a result, such conventional processes result in a substantial waste of such coating material.

SUMMARY OF THE INVENTION

The present invention provides a system and method of coating the seam on the inside surface of a container. The container is initially spun about an axis generally parallel to the seam. The seam of the container is engaged while the container is spinning to stop the container with the engaging means in registry with the seam. The interior of the container is coated along the seam while the container is stopped to provide a protective coating overlying the seam. If desired, a subsequent protective coating can be applied on the entire inside surface of the container.

With the system of the present invention, the initial coating is applied only to the seam and the area immediately surrounding the seam. This coating may be applied rather heavily to insure that the seam is fully covered with the protective coating. A second 360° coating may be applied in the conventional manner to sanitize the remainder of the interior of the can. However, this second coating need not be heavily applied since only minor imperfections in the initial coating used to construct the container need be covered.

It is immediately apparent that the system and method of the present invention result in a substantial saving in the coating material which must be used. The first coating applied along the seam can be heavily applied, but this heavy application of coating material is not wasted on the remainder of the interior of the can. The secondary coating can be relatively light. However, these coatings can be applied so as to insure that the seam is fully covered to prevent the introduction of lead from the solder used at the seam into the contents of the can.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 2 is a plan view of the apparatus of FIG. 1;

FIG. 3 is a sectional view of one of the cans as it is being sprayed;

FIG. 4 is a fragmentary view of the pawl mechanism of the present invention;

FIG. 5 is an enlarged view illustrating engagement of the tip of the pawl with the seam of the can.

DESCRIPTION OF THE PREFERRED EMBODIMENT

Figure 1:
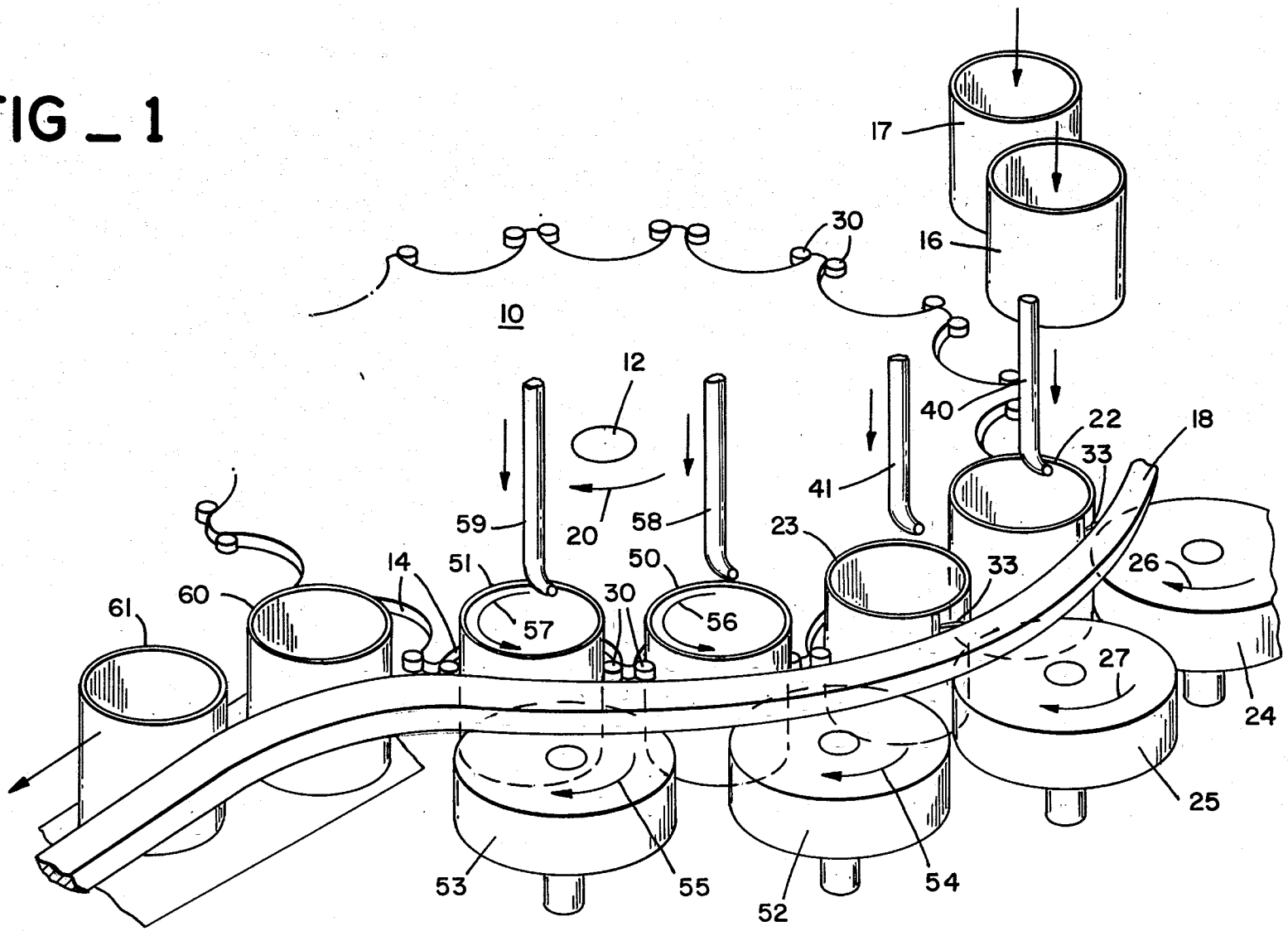
FIG. 1 is a perspective view of the apparatus of the present invention.

The system of the present invention is illustrated generally by way of reference to FIG. 1. The system includes a wheel 10 which is rotatable about axis 12. Wheel 10 has a plurality of outwardly opening recesses 14 in its outer circumference. Containers such as tin cans 16, 17 are dropped into recesses 14 and maintained within the recesses by a stationary curved bar 18.

Wheel 10 rotates in discrete steps about axis 12 as illustrated by arrow 20. As a result, cans such as 16, 17 move sequentially through various coating stations located along the circumference of the wheel. In the preferred embodiment of the present invention, cans such as 16, 17 are processed two at a time so that two cans are undergoing a given process at any given time.

The processing steps of the present invention are illustrated by way of reference to FIGS. 1 and 2 in combination. As illustrated therein, cans such as 16, 17 are first advanced to a first station wherein the cans 22, 23 illustrated are abutted against rollers 24, 25.

Rollers 24, 25 are driven in a clockwise direction as illustrated by arrows 26, 27. As a result, cans 22, 23 at the first station are spun in a counterclockwise direction as illustrated by arrows 28, 29. Each indentation 14 in wheel 10 is provided with a plurality of small idler rollers such as 30, 31 so that the cans are free to rotate.

A pair of pawls 32, 33 project from bar 18 so that they are in contact with the outer circumferential surfaces of cans 22, 23. As illustrated in more detail in FIG. 4, each pawl such as 32 is constructed of spring steel to bias the tip of the pawl against each can such as 22. As an obvious modification of the present invention, the pawl could be rigid and a spring used to bias the pawl against the can.

Metal containers of the type described herein are typically constructed of sheet steel which is bent into a curved configuration. The ends of the steel sheet are joined at a seam to form the can. As illustrated in FIG. 5, the seam 34 on the circumference of the can such as 22 provides a raised ridge area on the outer circumference of the can. This ridge is engaged by the tip of pawl 32 as the can is spinning about an axis parallel to the seam so that the can stops spinning with the pawl in registry with the seam.

To provide an airtight seal at seam 34, solder is usually applied along the seam. It is necessary that this solder be provided with a protective coating to protect the contents of the can. In addition, during the construction of the can, the protective coating provided on the sheet metal used may become scratched, particularly at the seam but in other locations as well, and it may be necessary to recoat the interior of the can other than just at the seam.

In order to provide a heavy protective coating along each seam such as 34 on cans 22, 23 at the first station, spray nozzles 40, 41 are employed. As illustrated in FIG. 2, the tips 42, 43 of spray nozzles 40, 41 are directed at the inside surface of the can proximate the tip of each pawl 32, 33. As a result, spray nozzles 40, 41 will be directed solely at the seam and surrounding area on the inside of the can.

As illustrated in FIG. 3, each spray nozzle such as 40 at the first station moves downwardly to position 40' within can 22 and then upwardly and out of the can as illustrated by arrow 44. As spray nozzle 40 moves either downwardly or upwardly within can 22, a coating is sprayed through nozzle tip 42 onto the seam. In this manner, contents of the can subsequently introduced will be protected from the solder used at the seam and also from metal adjacent the seam which may have been scratched during the construction of the can.

It may be desirable to provide a second protective coating throughout the entire interior of the cans. If so, wheel 10 moves so that cans such as 50, 51 are in registry with a pair of rollers 52, 53 at a second station. Rollers 52, 53 are driven in a clockwise direction as illustrated by arrows 54, 55 to drive cans 50, 51 in a counterclockwise direction as illustrated by arrows 56, 57. As cans 50, 51 are spinning, spray nozzles 58, 59 move downwardly and then upwardly within the cans to provide a full 360° coating within the can.

After each can has been provided with a first protective coating along the seam of the can, and a second protective coating if desired about the entire inner circumference of the can, the cans are moved to a subsequent position illustrated by cans 60, 61 in FIG. 1. The cans in this position have finished the coating process and can be removed from wheel 10 and filled as desired.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A method of coating the inside surface of a metal container during its continuous advance along a series of processing stations, comprising the steps of:

rotating the container about an axis generally parallel to the soldered side seam;

engaging the seam of the container at a first station with seam engaging means to temporarily stop the container from rotating;

coating the interior of the container along the seam while the container is temporarily stopped from rotating to provide a protective coat overlying said seam;

disengaging said engaging means to allow the container to resume its rotation advancing the rotating container to a second station; and coating substantially the entire inside of the container including the seam with a second protective coat while the container is rotating.

2. A method as recited in claim 1 wherein said rotating step comprises the steps of abutting the outer circumferential surface of the container against a roller, and driving the roller to rotate the container about said axis.

3. A method as recited in claim 1 wherein said engaging step includes biasing a pawl against the outer circumference of the container so that the pawl engages said seam.

4. A method of coating the inside surface of a container comprising the steps of:

abutting the outer circumferential surface of the container against a roller;

driving the roller to spin the container about its axis;

biasing latching means against the outer surface of the spinning container at a first station so that the latching means engages the soldered side seam of the container to stop the container from spinning with the latching means in registry with the seam;

coating the interior of the container along the seam while the container is stopped from spinning to provide a protective coating overlying said seam;

disengaging said latching means to allow the container to resume its rotation; advancing the rotating container to a second coating station; and coating substantially the entire inside of the container including the seam with a second protective coat to sanitize the interior of the container while the container is rotating.

* * * * *